US005230203A

United States Patent [19]

Wu et al.

[11] Patent Number: 5,230,203

[45] Date of Patent: Jul. 27, 1993

[54] APPARATUS AND METHOD FOR PROVIDING SEALED CONTAINERS FILLED WITH A LIQUID

[75] Inventors: Samuel C. Wu, Lakewood; Thomas T. Melsheimer, Berthoud; Allen E. Sauer, Golden, all of Colo.

[73] Assignee: Coors Brewing Company, Golden, Colo.

[21] Appl. No.: 867,137

[22] Filed: Apr. 10, 1992

[51] Int. Cl.[5] ..... B65B 3/12; B65B 3/18; B65B 3/32; B65B 7/28

[52] U.S. Cl. ..... 53/471; 53/202; 53/282; 53/284.5; 53/503; 141/5; 141/258; 141/259

[58] Field of Search ..... 53/503, 202, 284.5, 53/151, 471, 473, 282; 141/258, 259, 260, 266, 177, 5

[56] References Cited

U.S. PATENT DOCUMENTS

| | | | |
|---|---|---|---|
| 2,245,287 | 6/1941 | Minard | 53/503 X |
| 2,404,232 | 7/1946 | Hunter | 53/202 X |
| 2,875,566 | 3/1959 | Sevenpifer | 53/334 |
| 2,965,141 | 12/1960 | Höyer | 141/258 X |
| 3,533,216 | 10/1970 | Lange | 53/202 X |
| 3,626,997 | 12/1971 | Whitaker et al. | 141/258 X |
| 3,953,957 | 5/1976 | Brothers et al. | 53/334 X |
| 4,373,560 | 2/1983 | Elsworth | 141/258 X |
| 4,586,545 | 5/1986 | Marchadour | 141/258 X |
| 4,778,079 | 10/1988 | Judex | 141/259 X |
| 4,842,026 | 6/1989 | Nordmeyer et al. | 141/258 X |

*Primary Examiner*—Horace M. Culver

*Attorney, Agent, or Firm*—Klaas, Law, O'Meara & Malkin

[57] ABSTRACT

A modular system for filling and seaming a plurality of containers moving in parallel linear directions using a plurality of modules wherein each module comprises container filling apparatus, lid placing apparatus and lid seaming apparatus.

21 Claims, 3 Drawing Sheets

APPARATUS AND METHOD FOR PROVIDING SEALED CONTAINERS FILLED WITH A LIQUID

FIELD OF THE INVENTION

This invention relates generally to the filling and seaming of containers with a liquid and is particularly directed to a modular system for filling and seaming a plurality of containers with a liquid such as a carbonated beverage such as beer.

BACKGROUND OF THE INVENTION

Beverage containers, such as beverage cans, are filled with beverages such as beer, soft drinks, etc., in a container filling machine just prior to the application of a lid thereto in a seamer machine which lid is then seamed to the filled container while in the seamer machine. In order to increase productivity, container filling machines have been designed to operate at relatively high speeds. Typical high speed container filling machines are capable of filling containers at a rate of between 500 to 2000 cans per minute. One of such types of container filling machines is schematically illustrated in U.S. Pat. No. 4,664,159 to L. M. Dugan. Due to the centrifugal force generated by the high speed rotation of the container filling machine, it is necessary to provide each container with a height that is greater than that required to hold the amount of liquid to be contained therein. Even with an excess height there is a problem with beer being spilled out of the containers as the container filling machine rotates. During the rotation of the container filling machine, it is necessary to open and close a valve used to fill the containers. This requires one cam to open the valve and another cam to close it. When it is necessary to replace these cams, the entire container filling machine has to be stopped. It is usual to shut down a container filling machine on an annual basis for overhaul which causes the container filling machine to be idle for about two weeks. Every time it is necessary to repair a part of the container filling machine, it is necessary to shut down the complete operation.

BRIEF DESCRIPTION OF THE INVENTION

This invention provides a modular system for filling and seaming a plurality of containers moving in parallel linear directions using a plurality of modules wherein each module comprises container filling apparatus; lid placing apparatus and lid seaming apparatus.

In a preferred embodiment of the invention, a plurality of empty containers are moved by conventional conveyor means to converging apparatus where they are formed into a single-file relationship in parallel rows. The empty containers move into contact with a screw-type conveyor having a thread having a gradually increasing pitch until successive containers are spaced a fixed distance apart. The pitch of the thread then remains constant as the containers are moved through a plurality of operations as described below. The containers are moved by the screw conveyor over a stationary surface.

The container filling apparatus of each module comprises a housing removably mounted at a relatively fixed location. Movable valve means are located in the housing and preferably comprise a rotatable member having a transverse bore extending therethrough. Adjustment means are mounted in the transverse bore and are moved to form a cavity of a desired volume, such as 8, 12, or 16 ounces. The adjustment means comprise a plug having an O-ring in contact with the sidewall defining the bore. The plug has valve means, such as a float valve, mounted therein (for purposes described below) and moves with the plug. The outer surface of the rotatable member is cylindrical and fits closely into a cylindrical bore in the housing. An exit passageway is formed in the lower portion of the housing and has a first portion in fluid communication with the cylindrical bore in the housing and a second enlarged portion to the container. If desired, sealing means, such as a silicone seal, may surround the second enlarged portion. The second enlarged portion has a configuration similar to an end portion of the container so that the container may be moved upwardly and be located within the second enlarged portion to be in a position to be filled with a liquid, such as beer. The rotatable member moves between a first location having filling means to fill the cavity and a second location where the liquid is deposited into a container. The filling means comprises a header having the liquid under pressure which is about 15 to 40 psi when the liquid is beer. A tube extends between and is connected to the header and a filling passageway in the housing which passageway has an opening in the cylindrical bore of the housing. When in the first location, the transverse bore in the rotatable member is aligned with the filling passageway so that the liquid can flow into the cavity. In a preferred embodiment of the invention, when the rotatable member is in the first location, the plug is at a higher elevation than the filling passageway so that as the cavity is being filled, any gaseous materials therein will be moved through the valve mean in the plug and exit through a vent passageway in the housing.

In operation, the rotatable member is moved to the first location. When the rotatable member is in the first location, the first opening of the exit passageway is in a sealed relationship with the cylindrical outer surface of the rotatable member. A first container is moved upwardly into a sealed relationship with the second enlarged opening of the exit passageway. A vacuum tube in the housing operates to reduce the pressure in the first container to about 11.5 psi. A purge tube in the housing then purges the first container using a gaseous material, such as carbon dioxide, under pressure of about 15 to 40 psi. A vent tube in the housing allows exhaust of the purged gaseous material. The valving of the vacuum tube, purge tube and vent tube are closed to allow the container to be pressurized to about 15 to 40 psi. The rotatable member is then rotated to the second location whereat the liquid therein is deposited into the first container. The filled first container is moved downward and the screw conveyor moves the filled container to a location under the lid placing apparatus and at the same time moves a second container under the container filling apparatus. After the lid has been placed on the first filled container and the second container has been filled, the screw conveyor moves the first container under the lid seaming apparatus, the second container under the lid placing apparatus and a third container under the container filling apparatus. After the lid has been seamed on the first container, the lid placed on the second container and the third container has been filled, the screw conveyor operates to move the filled and sealed first container onto a transfer conveyor for movement to other operations, the second container under the lid seaming apparatus, the third container under the lid placing apparatus and a fourth container under the container filling apparatus. It is understood that, in a continuous operation, the container filling apparatus, the lid placing apparatus and the lid seaming apparatus operate simultaneously.

In another preferred embodiment of the invention, the movable valve member moves in a linear direction.

BRIEF DESCRIPTION OF THE DRAWINGS

Illustrative and presently preferred embodiments of the invention are shown in the accompanying drawings in which.

DETAILED DESCRIPTION OF THE INVENTION

Figure 1:
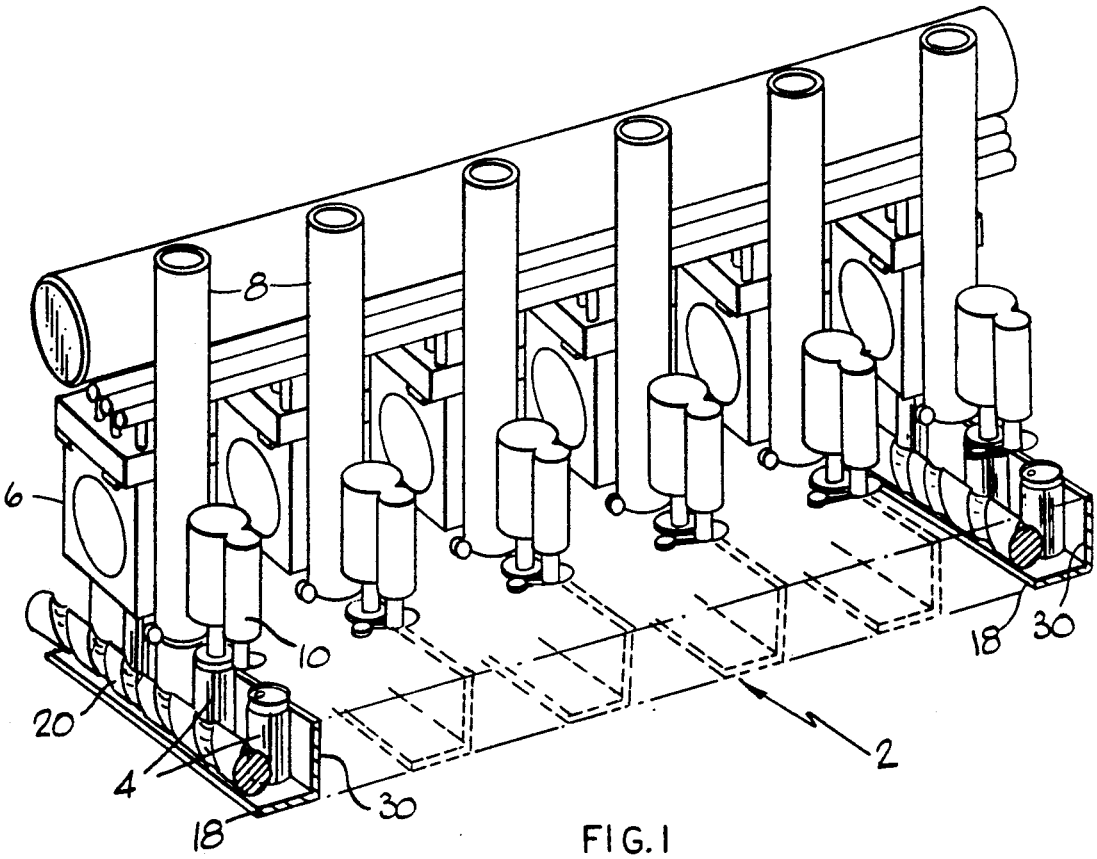
FIG. 1 is a perspective view of the apparatus of this invention.

In FIG. 1, there is illustrated a modular filler-seamer system 2 wherein a plurality of parallel rows of containers 4 are moved beneath container filling apparatus 6, lid placing apparatus 8 and lid seaming apparatus 10.

Figure 2:
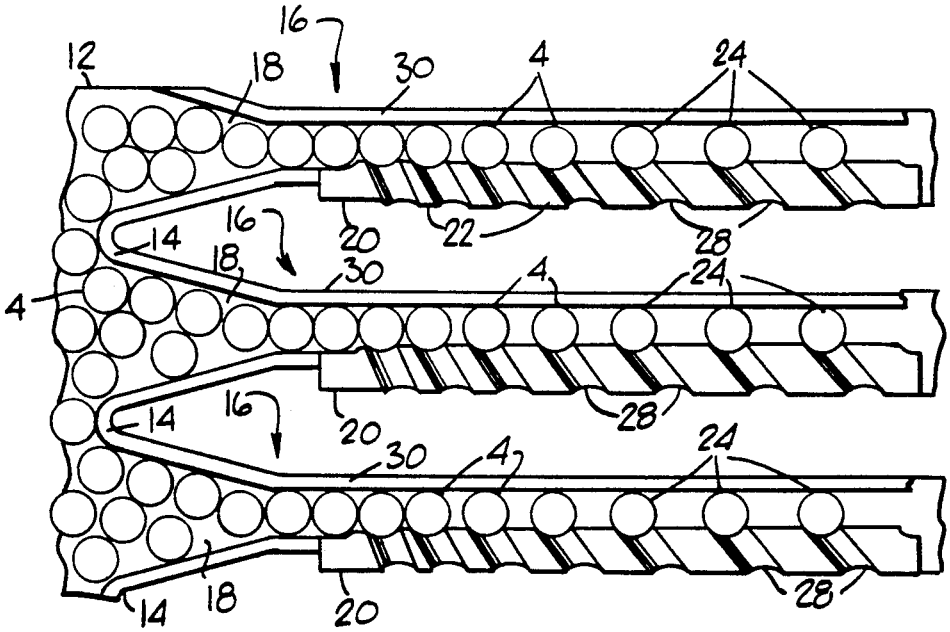
FIG. 2 is a top plan view of a portion of a conveyor system used in this invention.

The system for forming the parallel rows of containers 4 is illustrated in FIG. 2 and comprises a moving conveyor 12 for moving a plurality of containers into a plurality of forming means 14 which forms the plurality of containers into parallel rows 16. As the containers 4 are formed into the parallel rows 16, they move over a plurality of stationary plate members 18 having a smooth planar upper surface. As the container 4 are formed into the parallel rows 16, they move over a plurality of stationary plate members 18 having a smooth planar upper surface. As the container 4 move over each stationary plate member 18, they move into contact with a screw conveyor 20 having a thread 22 having a gradually increasing pitch until the containers 4 are spaced apart a desired predetermined distance at which time the pitch remains constant so that successive containers 4 are equally spaced apart as indicated at 24. In the preferred embodiment, the containers 4 are spaced apart a distance so that one turn of the screw conveyor 20 will move a container 4 from beneath the container filling apparatus 6 to the lid placing apparatus 8, from the lid placing apparatus 8 to the lid seaming apparatus 10 and from the lid seaming apparatus 10 to a transfer conveyor 26, FIG. 3. The screw conveyor 20 has an arcuate surface 28 extending between the thread 22 to mate with the outer surface of the containers 4. A guide rail 30 maintains the containers 4 against the arcuate surface 28 to move the containers 4 over the stationary plate member 18.

Figure 3:
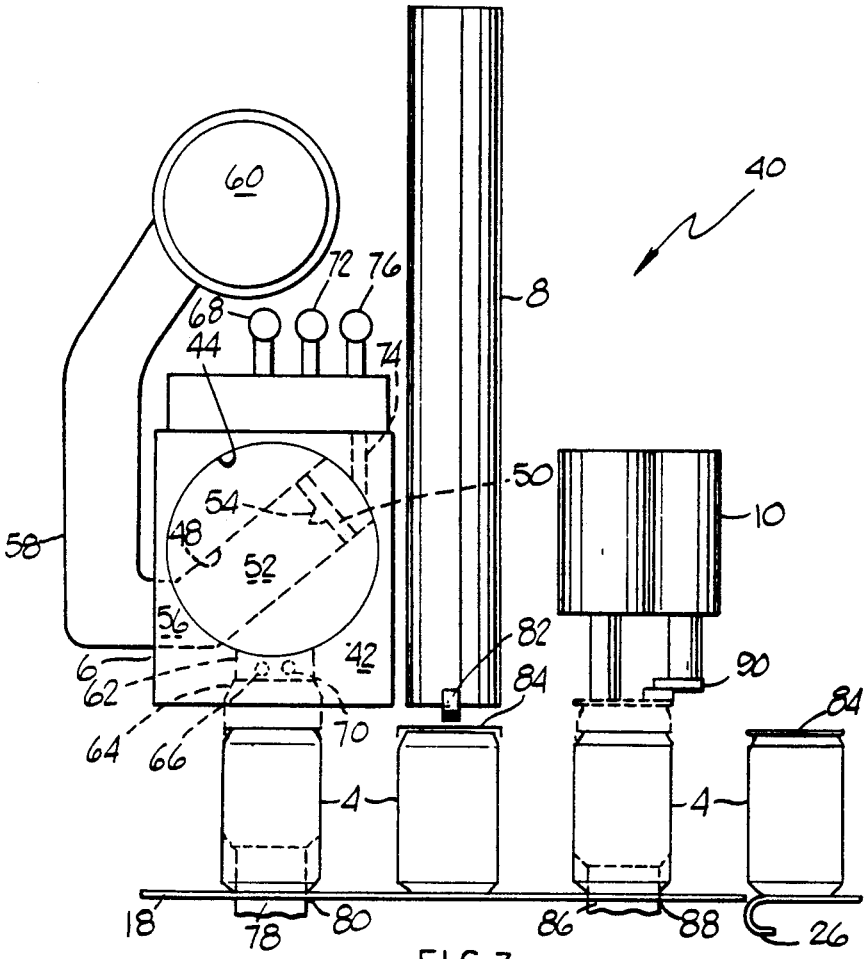
FIG. 3 is a schematic illustration of one module of this invention.

A module 40 for the modular filler-seamer system 2 is schematically illustrated in FIG. 3. The container filling apparatus 6 comprises a housing 42 having a generally rectangular shape and a cylindrical bore 44 extending partially therethrough. Movable valve means are provided and comprise a rotatable member 46 having a transverse bore 48 extending therethrough. Adjustment means are provided and comprise a plug 50 slidably mounted in the transverse bore 48 so as to form a cavity 52 having a desired volume, such as 8, 12 or 16 ounces. Valve means 54, such as a float valve, are mounted in the plug 50 for movement therewith. The plug 50 can be dimensioned to form its own seal against the sidewall of the transverse bore 48 or an 0-ring (not shown) can be located between the plug and the sidewall of the transverse bore 48. A fill passageway 56 is formed in the housing 42 and is in alignment with the transverse bore 48 when the cavity 52 is being filled, as illustrated in FIG. 3. A tube 58 extends between and is connected to the fill passageway 56 and a beverage header 60 having a beverage, such as beer, contained therein under pressure.

An exit passageway is formed in the housing 42 and comprises a first portion 62 having a cross-sectional configuration similar to the transverse bore 48 and a second portion 64 having a cross-sectional configuration similar to that of the end portion of a container 4. If desired, the second portion 64 may comprise a silicone seal. A vacuum opening 66 is located in the first portion 62 and is connected through a valve control to a vacuum tube 68. A carbon dioxide opening 70 is located in the first portion 62 and is connected through a control valve to a tube 72 having carbon dioxide under pressure contained therein. A vent passageway 74 in the housing 42 is connected through a control valve to a vent tube 76. A pusher 78 moves through an opening 80 in the stationary plate 18 to upwardly move a container 4 into the second portion 64.

When the screw conveyor 20 moves a container 4 under the lid placing apparatus 8, a sensor 82 detects its presence and functions to place a lid 84 on the container 4. When the screw conveyor 20 moves a container 4 under the lid seaming apparatus 10, a pusher 86 moves through an opening 88 in the stationary plate 18 to upwardly move a container 4 in position so that lid seaming mechanism will seam the lid 84 on the container 4.

Figure 4:
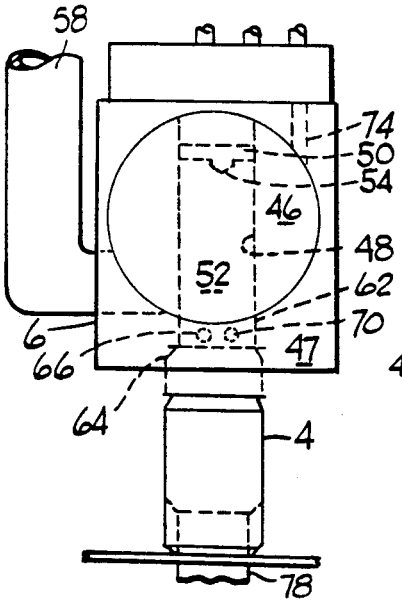
FIG. 4 is a view of a portion of FIG. 3 with the valve at the discharge location.
Figure 5:
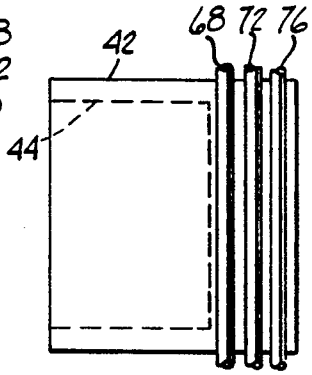
FIG. 5 is a top plan view of a portion of FIG. 3 with parts removed.

The operation of a module 40 is illustrated in FIGS. 3 and 4. The filling of the cavity 52 is illustrated in FIG. 3. The rotatable member 46 is moved by suitable mechanism (not shown) so that the transverse bore 48 is aligned with the filling passageway 56. The beverage flows from the beverage header 60 through the tube 58 to fill the cavity 52. As the beverage flows into the cavity 52, it forces any gaseous materials in the cavity 52 through the valve means 54 and out through the vent passageway 74. At the same time, the pusher 78 moves a container 4 into contact with the second portion 64. The container 4 is then subjected to conventional operations prior to being filled. A solenoid valve (not shown) operates to connect the vacuum opening 66 to the vacuum tube 68 to removed air from the container and lower the pressure in the container 4. The vacuum is then cut off and another solenoid valve (not shown) connects the carbon dioxide opening 70 to the tube 72 so that carbon dioxide under pressure flows into the container 4. The valves are then closed to allow the pressure in the container to be raised to between about 15 to 40 psi. The rotatable member 46 is then moved until the transverse bore 48 is aligned with the first portion 62. As the transverse bore 48 moves over the first portion 62, the beverage in the cavity 52 flows into the container 4. At the same time, a lid 84 is placed on a filled container 4 and a lid 84 is seamed on a filled container 4.

Figure 6:
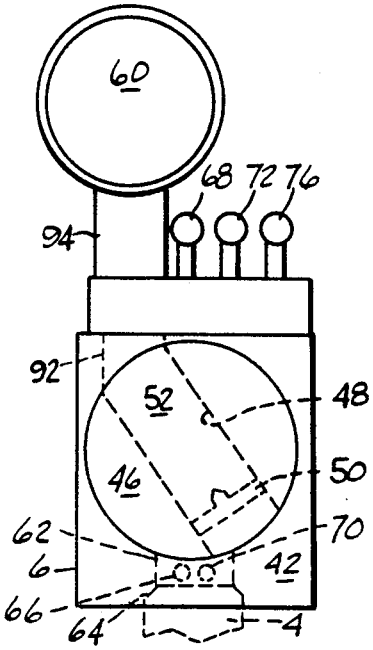
FIG. 6 is a schematic illustration of another embodiment of the container filling apparatus of this invention.

Another embodiment of the invention is illustrated in FIG. 6. The apparatus in FIG. 6 differs from that illustrated in FIGS. 3 and 4 in that the fill passageway 92 is located adjacent to the top of the housing 42 and a relatively short tube 94 connects the beverage header 60 to the fill passageway. Also, the plug 50 does not have the valve means 54.

Figure 7:
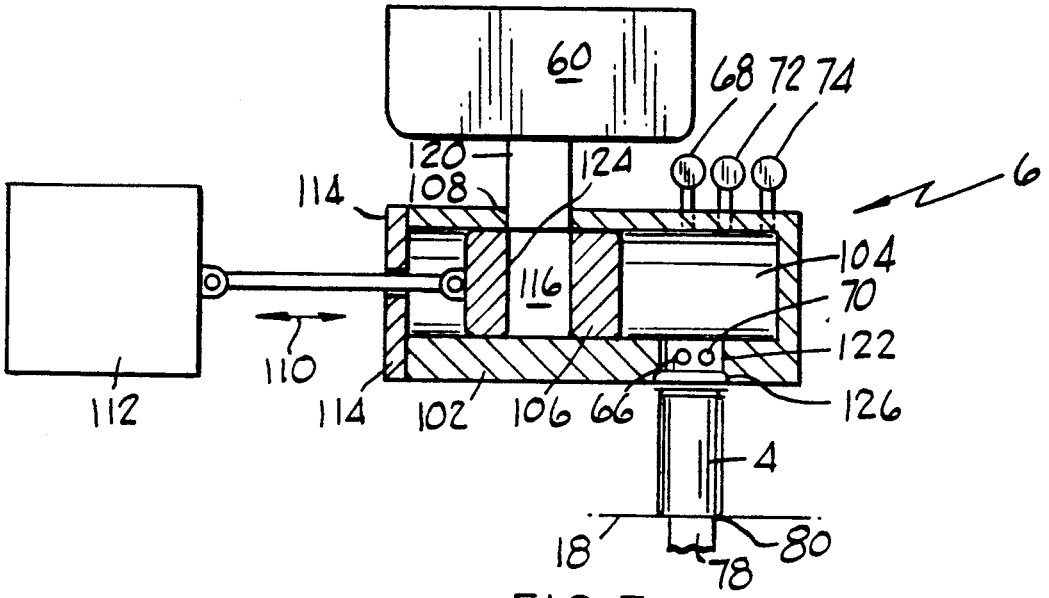
FIG. 7 is a side elevational view with parts in section of another preferred embodiment of the invention with the valve member in a filling location.
Figure 8:
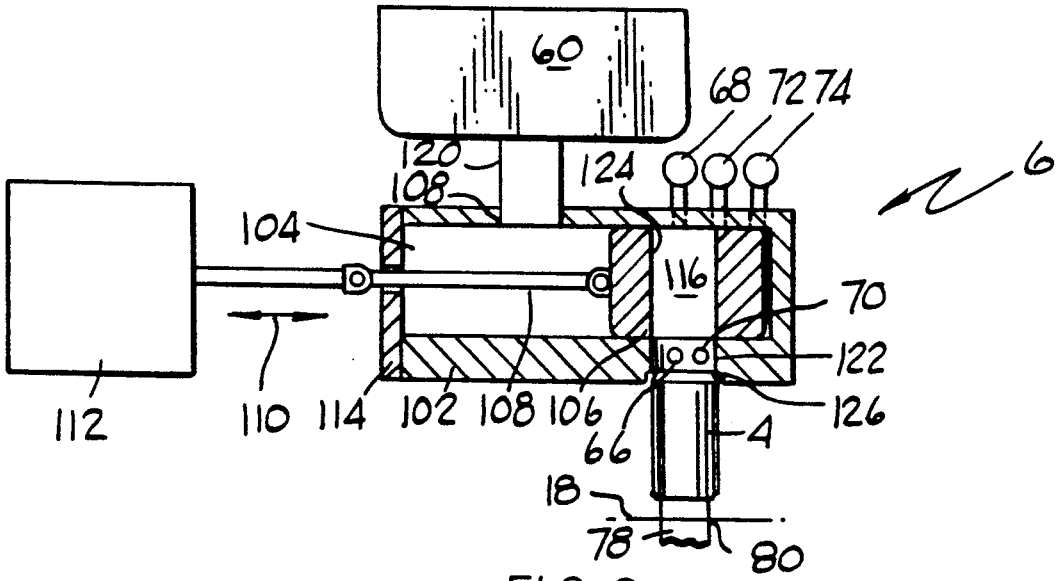
FIG. 8 is a view similar to FIG. 7 with the valve member in a discharge position.

In FIGS. 7 and 8, there is illustrated another preferred embodiment of the invention wherein the movable valve member moves in linear directions. Parts in FIGS. 7 and 8 corresponding to those in FIGS. 1-6 have been given the same reference numerals. The apparatus in FIGS. 7 and 8 would replace the container filling apparatus of FIGS. 1 and 6.

The container filling apparatus 6 in FIGS. 7 and 8 comprises a housing 102 mounted by suitable means (not shown) at a fixed location. The housing 102 has a longitudinally extending bore 104 formed therein. Movable valve means are provided and comprise a member 106 mounted for linear sliding movement in the bore 104. A rod 108 is connected to the member 106 and is reciprocated in the directions indicated by the arrow 110 by reciprocating apparatus 112. The housing 102 has a removable cover plate 114 so that the member 106 may be inserted into the bore 104. The member 106 has a cavity 116 formed therein which has a volume corresponding to that of the container 4. The housing has a fill passageway 118 formed therein. A tube 120 connects the header 60 to the fill passageway 118. An exit passageway is formed in the housing 102 and has a first portion 122 similar to the wall 124 and a second portion 126 having a configuration similar to that of the end portion of a container 4.

In operation, the reciprocating apparatus 112 moves the member 106 so that the cavity 116 is located under the fill passageway 118 so that it is filled with a beverage from the header 60. The reciprocating apparatus 112 then moves the member 106 until the cavity 116 is located over the first portion 122 to fill the container with the beverage.

While illustrative and presently preferred embodiments of the invention has been described in detail herein, it is to be understood that the inventive concepts may be otherwise variously embodies and employed and that the appended claims are intended to be construed to include such variations except insofar as limited by the prior art.

What is claimed is:

1. Apparatus for use in providing sealed containers filled with a liquid comprising:

a housing;

moving means for moving a plurality of containers in at least one linear direction and passing under said housing;

movable valve means mounted in said housing and having at least one cavity formed therein;

said movable valve means moving between a first location at which said cavity is filled with a liquid and a second location at which said liquid is deposited into one of said plurality of containers beneath said cavity;

valve means in said cavity for permitting discharge of gaseous materials from said cavity during said filling thereof with said liquid;

lid placing means for placing a lid on each of said containers having said liquid therein; and lid seaming means for seaming said lid to each of said containers.

2. Apparatus as in claim 1 wherein:

said lid placing means being located along said at least one linear direction.

3. Apparatus as in claim 2 wherein:

said lid seaming means being located along said at least one linear direction.

4. Apparatus as in claim 1 and further comprising:

control means for controlling the operation of said apparatus so that as said lid is being seamed on one container, said lid is being placed on a filled second container and a third container is being filled.

5. Apparatus as in claim 1 and further comprising:

adjustment means for adjusting the volume of said cavity prior to the filling thereof.

6. Apparatus as in claim 5 wherein said adjustment means comprises:

said cavity in said movable valve means comprising a bore extending through said movable valve means;

a plug movably mounted in said bore; and retaining means for retaining said plug at a desired location in said bore.

7. Apparatus as in claim 1 and further comprising:

said cavity having at least one open end and at least one partially closed end;

said at least one open end being located closer to said container beneath said housing than said at least one partially closed end when said cavity is at said first location.

8. Apparatus for filling containers with a liquid comprising:

a housing;

moving means for moving a plurality of containers in at least one linear direction and passing under said housing;

movable valve means mounted in said housing and having at least one cavity formed therein;

said movable valve means moving between a first location at which said cavity is filled with liquid and a second location at which said liquid is deposited into one of said containers;

said cavity having at least one opened end and at least one partially closed end; and valve means in said at least one partially closed end for permitting discharge of gaseous materials from said cavity during said filling thereof with said liquid.

9. Apparatus as in claim 8 and further comprising:

sad at leat one open end being located closer to said container beneath said housing than said at least one partially closed end when said cavity is at said first location.

10. Method for providing sealed containers filled with a liquid using apparatus having a movable valve means located in a housing and having at leat one cavity formed therein and having an open end and at leat a partially closed end comprising:

moving a plurality of containers in at leat one linear direction to move sequentially into a container filling station, a lid placing station and a lid seaming station;

stopping the movement of said plurality of containers so that an unfilled container is at said container filling station, a filled container is at said lid placing station and a filled container having a lid thereon is at said lid seaming station;

moving said movable valve means to a first location at which said cavity is filled with a liquid;

forcing gaseous materials from said cavity as said cavity is being filled with said liquid;

moving said movable valve means to a second location at which said liquid in said cavity is deposited into said container;

placing a lid on a container having said liquid therein at the same time as said cavity is being filled with said liquid; and seaming a lid to a container having a lid thereon at the same time as said cavity is being filled with said liquid.

11. Method as in claim 10 and further comprising:

location said open end closer to said container than said partially closed end when said cavity is being filled with said liquid; and venting said gaseous material forced from said cavity to atmosphere.

12. Apparatus for use in providing sealed containers filled with a liquid comprising:

a plurality of independently operable modules in a side by side relationship;

each of said modules having an entrance portion and an exit portion;

moving means for moving a plurality of containers through each of said modules in a linear direction; and each of said modules having filling means for filling each of said containers with a liquid; lid placing means for placing a lid on each of said containers having said liquid therein and lid seaming means for seaming said lid to each of said containers.

13. Apparatus as in claim 12 and further comprising:

control means for controlling the operation of said filling means, said lid placing means and said lid seaming means so that an unfilled container is filled with a liquid, a filled container has a lid placed thereon and the lid of a filled container having a lid therein is seamed to the container during the same interval of time.

14. Apparatus as in claim 13 wherein each of said filling means comprises:

a housing;

movable valve means mounted in said housing and having at least one cavity formed therein;

said movable valve means moving between a first location at which said cavity is filled with a liquid and a second location at which said liquid is deposited into one of said plurality of containers; and valve means in said cavity for permitting discharge of gaseous materials from said cavity during said filling thereof with said liquid.

15. Apparatus as in claim 14 and further wherein:

each of said movable valve means are reciprocated in linear direction; and said plurality of linear directions of said containers are in parallel relationship.

16. Apparatus as in claim 14 wherein:

each of said movable valve means comprises rotatable valve means; and said plurality of linear directions are in a parallel relationship.

17. Apparatus as in claim 14 and further comprising:

adjustment means for adjusting the volume of each of said cavities prior to being filled.

18. Apparatus as in claim 17 wherein said adjustment means comprises:

said cavity in said movable valve means comprising a bore extending through said movable valve means;

a plug movably mounted in said bore; and retaining means for retaining said plug at a desired location in said bore.

19. Apparatus for use in providing sealed containers filled with a liquid comprising:

a housing;

moving means for moving a plurality of containers in at leat one linear direction and passing under said housing;

movable valve means mounted in said housing and having at least one cavity formed therein;

adjusting means for adjusting the volume of said cavity prior to being filled;

said movable valve mean moving between a first location at which said cavity is filled with liquid and a second location at which said liquid is deposited into one of said plurality of containers beneath said cavity;

lid placing means located along said linear direction for placing a lid on each of said containers having said liquid therein; and lid seaming means located along said linear direction for seaming said lid to reach of said containers.

20. Apparatus as in claim 19 wherein said adjustment means comprises:

said cavity in said movable valve means comprising a bore extending through said movable valve means;

a plug movably mounted in said bore; and retaining means for retaining said plug at a desired location in said bore.

21. Apparatus as in claim 19 and further comprising said cavity having at least one open end and at least one partially closed end;

said at least one open end being located closer to said container beneath said housing then said at least one partially closed end wherein said cavity is at said first location; and valve means in said cavity for permitting discharge of gaseous materials from said cavity during said filling thereof with said liquid.

* * * * *